US006234764B1

(12) United States Patent
Obermoser

(10) Patent No.: US 6,234,764 B1
(45) Date of Patent: May 22, 2001

(54) HYDRAULIC RAM PUMP

(76) Inventor: Karl Obermoser, Vogtstr. 15, D-86653 Honheim (DE)

( * ) Notice: Subject to any disclaimer, the term of this patent is extended or adjusted under 35 U.S.C. 154(b) by 0 days.

(21) Appl. No.: 09/142,312

(22) PCT Filed: Apr. 16, 1997

(86) PCT No.: PCT/EP97/01908

§ 371 Date: Sep. 3, 1998

§ 102(e) Date: Sep. 3, 1998

(87) PCT Pub. No.: WO97/40277

PCT Pub. Date: Oct. 30, 1997

(30) Foreign Application Priority Data

Apr. 19, 1996 (DE) ..... 196 15 689
Dec. 4, 1996 (EP) ..... 96119475

(51) Int. Cl.[7] ..... F04F 7/02
(52) U.S. Cl. ..... 417/226; 417/65
(58) Field of Search ..... 417/226, 92, 65

(56) References Cited

U.S. PATENT DOCUMENTS 5,725 * 8/1848 Leighton ..... 417/226
4,054,399 * 10/1977 Maurer ..... 417/226
4,073,604 * 2/1978 Chen ..... 417/226

FOREIGN PATENT DOCUMENTS

307348 * 10/1916 (DE) .
1952034 A1 * 12/1995 (DE) .

* cited by examiner

*Primary Examiner*—Henry C. Yuen
*Assistant Examiner*—Mahmoud Gimie
(74) *Attorney, Agent, or Firm*—Hedman & Costigan

(57) ABSTRACT

The invention relates to a hydraulic ram pump, comprising: a propulsion water line fed with propulsion water, a delivery line which can be connected to delivery water via a bottom valve, a ram pump valve which is connected to the propulsion water line and delivery line, the propulsion water flowing into the delivery line when the ram pump valve is open and, after the closing of the ram pump valve, the water column flowing further in the delivery line sucking in delivery water via the bottom valve, the ram pump valve being held by spring force in its closed position separating the propulsion water line from the delivery line, and a pressure reservoir being provided, which is connected to the propulsion water line upstream of the ram pump valve in the direction of flow, the valve member being of annular design, axially movable and tightly connected to the delivery line, the effective cross section of this connection being larger than the cross section of the valve seat, and the valve seat of the ram pump valve and the valve seat of the bottom valve being mechanically coupled in order to transmit kinetic energy.

8 Claims, 2 Drawing Sheets

HYDRAULIC RAM PUMP

BACKGROUND OF THE INVENTION

The invention relates to a hydraulic ram pump for converting low amounts of water at high pressure into large amounts of water at low pressure. Such ram pumps are also designated suction rams. Rams denote ram pumps which can be used in reverse for the conversion of large amounts of water at low pressure into low amounts of water at high pressure. The ram pump according to the invention can do both, that is to say it can optionally be used to increase pressure or to increase volume flow.

Suction rams have been known at least since 1905 ("Trägheitsmaschinen als Möglichkeit der hydraulisch-mechanischen Energieumformung" [Inertial machines as an option for hydraulic-mechanical energy conversion], presentation by Ivan Cyphelly, Fegawerk/Switzerland, held at the IHP of RWTH Aachen, Prof. Backé, Jun 21, 1991). They employ a ram valve which, as in the case of the hydraulic rams having a propulsion water pipe and a natural drop, is abruptly closed by the hydrodynamic pressure drop which is produced by the water flowing through the valve.

In the case of known suction rams (for example German Patent No. 804,288, 1949, or in the case of the suction ram still built today by the company Fegawerk S. A., Le Locie/Switzerland), when the ram valve closes the kinetic energy of the flowing water in the propulsion water line is dissipated, because the propulsion water is stopped. In order to keep this loss as small as possible, the suction ram from Fegawerk has as the propulsion water line a hose having an extremely large cross section, by which means high velocities of the propulsion water are additionally avoided.

The above-mentioned known suction rams require a specific constant propulsion water volume flow for satisfactory functioning, since when the propulsion water volume flow falls below that needed, the ram pump valve no longer closes and the efficiency falls to zero.

The ram valve is exposed to a particularly high loading as a result of the abrupt stopping of the propulsion water column, this loading being still considerably higher in known suction rams than in conventional hydraulic rams in which, as the result of the stopping of the propulsion water column, the pressure which is backed up at the valve is only that which must be achieved in order to deliver into an air receiver. This high loading on the ram pump valve has an unfavorable effect on the lifetime of the known suction ram.

These disadvantages are overcome by the ram pump described in the German Patent Application DE 19520343, which is not a prior publication (EPC Art. 54(3)), according to which the ram pump valve is not formed as a nonreturn valve, as in the previously mentioned prior art, which is held open by spring force and closed by the propulsion water flow, but as a valve which is held closed by spring force and opened by the propulsion water pressure.

SUMMARY OF THE INVENTION

Furthermore, according to the invention, provision is made to actuate the ram pump valve cyclically in the manner of an oscillatory circuit in cooperation with a pressure reservoir element which is likewise acted on by the propulsion water. Because of its construction, this suction ram can operate both to increase pressure and also to increase volume flow.

Since in the case of this ram pump the propulsion water pressure is taken up, before the opening of the ram pump valve, by the pressure-adjustable element of a pressure reservoir element, it is ensured that the propulsion water is not stopped abruptly when the ram pump is operating but rather can be fed to the latter continuously, by which means the ram pump valve is distinctly relieved of load in comparison with the prior art, which is to the benefit of the lifetime of the ram pump as a whole.

By means of the construction of the ram pump valve of this ram pump as a closing valve, and its driving by the propulsion water in conjunction with a pressure reservoir element, it is furthermore achieved that the ram pump valve still opens even at the smallest propulsion water volume flow, since the opening pressure for the ram pump valve is built up by the pressure reservoir element even given a minimal propulsion water flow. This therefore also achieves a distinct increase in the efficiency of the ram pump in comparison to the suction ram treated above.

Further details of this ram pump are explained in more detail below using FIGS. 1 and 2 of the drawing, according to which:

DESCRIPTION OF THE PREFERRED EMBODIMENTS

Figure 1:
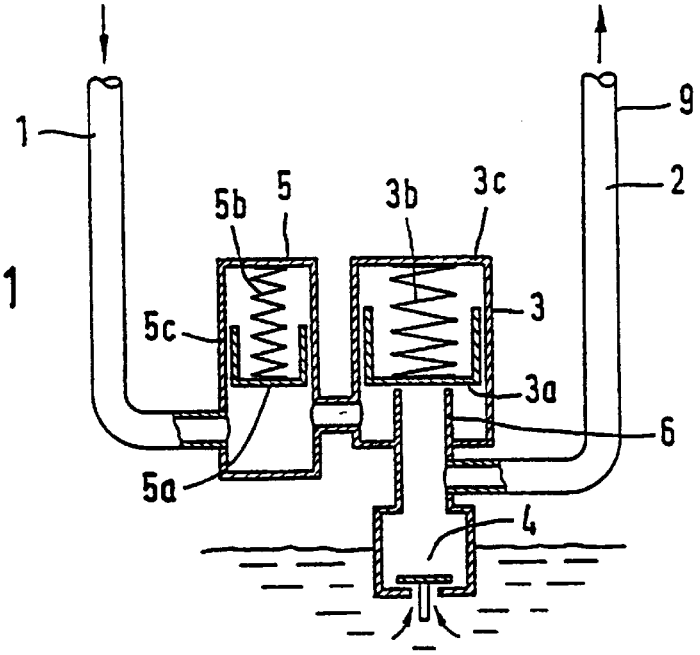
FIG. 1 shows a schematic representation of a first embodiment.
Figure 2:
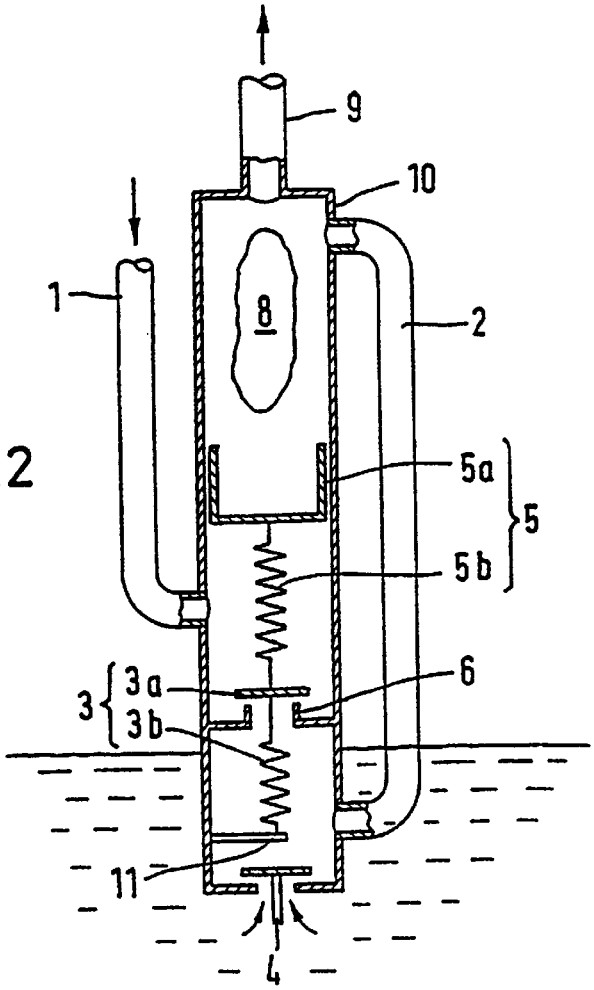
FIG. 2 shows a second embodiment of the ram pump described in DE 19520343, which is not a prior publication.

The hydraulic ram pump shown in FIGS. 1 and 2 in general comprises in a conventional way a propulsion water line 1, a delivery water line 2, a ram pump valve 3 and a bottom valve 4 for sucking up delivery water. Located at the end of the delivery water line 2 is the ram outlet 9. The ram pump valve 3 comprises a piston 3*a* and a restoring or closing spring 3*b* which biases the piston 3*a* against a valve seat 6. The ram pump valve 3 is held closed by a spring.

Furthermore, provision is made that the propulsion water line 1 is connected not only as in the prior art to the pressure side of the ram pump valve 3 but additionally to a spring reservoir 5.

The pressure reservoir element 5 is formed as a spring reservoir in the embodiments of the ram pump shown in FIGS. 1 and 2.

According to the embodiment shown in FIG. 1, the spring reservoir 5 has its own casing 5*c*, which communicates with the propulsion water line 1 upstream of the ram pump valve 3. Located in the casing 5*c* is a piston 5*a* which is biased by a spring 5*b* and which forms the pressure-adjustable element of the pressure reservoir element.

The piston 3*a*, the restoring spring 3*b* and the valve seat of the ram pump valve 3 are likewise accommodated in their own casing 3*c*, separate from the casing 5*c*, in the case of the embodiment of the ram pump shown in FIG. 1, with the result that the ram pump valve 3 and the spring reservoir 5 are effectively connected to each other only via the propulsion water.

In FIG. 2, the elements of the spring reservoir 5 and of the ram pump valve 3 are accommodated in a common casing 10 and coupled mechanically to one another: the piston 5*a* of the spring reservoir 5 is arranged at the upper end of the coupled piston-spring system, and the pressure reservoir spring 5*b* connects the piston 5*a* to the piston 3*a*, located beneath the latter, of the ram pump valve 3, whose restoring spring 3*b* runs in the upward direction and is fixed at a stationary abutment 11 in the casing 10. The lower end of the casing dips into the delivery water and is closed by the bottom valve 4.

The propulsion water line opens into the casing 10 at the level of the reservoir spring 5*b,* while the delivery water line branches off from the casing at the level of the lower end of the closing spring 3*b.*

The closing spring 3*b* and the pressure reservoir spring 5*b* are tension springs in the case of this embodiment of the suction ram of FIG. 2.

The ram pump shown in FIGS. 1 and 2 operates as follows:

The propulsion water flows through the propulsion water line 1 and stresses the pressure reservoir spring 5*b* via the propulsion water pressure acting on the piston 5*a* (pressure reservoir phase), until the pressure on the area of the ram pump valve piston 3*a,* less the area of the valve seat 6, overcomes the force of the restoring or ram pump valve closing spring 3*b*. The ram pump valve 3 then opens abruptly, since as the opening begins the propulsion water pressure acts on the area of the entire ram pump valve piston 3*a*. The reservoir spring 5*b* is now relieved (relief phase), in that it accelerates the mass of water in the delivery line 2 via a reciprocating movement of the piston 5*a,* as a result of which the pressure in this line falls until the force of the closing spring 3*b* overcomes the pressure on the entire area of the ram pump valve piston 3*a* and the ram pump valve closes. In the renewed pressure reservoir phase which now follows, the water flowing further in the delivery line 2 sucks water out of the bottom valve 4 until the water flow comes to a standstill because of the counter pressure as a result of the delivery head. Further relief and pressure reservoir phases then proceed cyclically.

The ram pump shown in FIG. 2 runs cyclically through pressure reservoir and relief phases, like the ram pump shown in FIG. 1. In contrast to the ram pump shown in FIG. 1, in the case of the ram pump of FIG. 2 the pressure reservoir piston 5*a,* because of its spring coupling to the ram pump valve piston 3*a,* partially takes over the changeover function of the latter. This means that the propulsion water stresses the pressure reservoir spring 5*b* via the propulsion water pressure acting on the piston 5*a* (pressure reservoir phase) until the pressure on its area, less the area of the valve seat 6, overcomes the force of the restoring or ram pump valve closing spring 3*b*. The ram pump valve 3 then opens abruptly, since as the opening begins the propulsion water pressure acts on the area of the entire pressure reservoir piston 5*a*. The pressure reservoir spring 5*b* is now relieved (relief phase), in that it accelerates the mass of water in the delivery line 2 via a reciprocating movement of the piston 5*a,* as a result of which the pressure in this line falls until the force of the closing spring 3*b* overcomes the pressure on the entire area of the pressure reservoir piston 3*a* and the ram pump valve closes. In the renewed pressure reservoir phase which now follows, the water flowing further in the delivery line 2 sucks water out of the bottom valve 4 until the water flow comes to a standstill because of the counter pressure as a result of the delivery head. Further relief and pressure reservoir phases then proceed cyclically.

In FIG. 2, there is additionally arranged in a free space of the casing 10 above the piston 3*b* an air-filled hose 8, which buffers the pulsating movements of the ram pump valve piston 3*b* and of the water in the delivery line 2, by which means a relatively quiet mass flow is ensured at the ram pump outlet 9. Other known means for buffering can in principle also be used.

The object of the present invention is to provide a hydraulic ram pump which, given a compact construction, ensures a high efficiency and a long lifetime, and can be operated both to increase pressure and to increase volume flow.

Accordingly, the hydraulic ram pump according to the invention is in principle constructed as shown in FIGS. 1 and 2 and explained above. A special feature of the ram pump according to the invention consists in a mechanical coupling of the valve seat of the ram pump valve to the valve seat of the bottom valve in such a way that the kinetic energy which arises when closing one valve is transmitted to the other valve for the purpose of opening its valve member. In addition to the advantages already treated above of a ram pump of this type, this achieves more favorable operation in terms of energy. A further advantage is that the detrimental section between the two valves, which represents a problem in the prior art, since the kinetic energy of the water in this connecting section cannot be utilized and, when the ram pump closes, can lead to cavitation in the latter, can be kept optimally short. Finally, a compact construction of the ram pump is ensured by the fact that the ram pump valve and the bottom valve are arranged directly adjacent to each other and axially.

The compact construction benefits from a design of the pressure reservoir in the shape of a bellows which carries the valve member of the ram pump valve at one end. Likewise beneficial to the compact construction is the arrangement of the restoring spring for the valve member of the ram pump valve inside the pressure reservoir bellows. Finally, according to the invention the compact construction benefits from the formation of the restoring spring for the bottom valve in the shape of a bellows which is arranged in the pump in such a way that the delivery water passes through it.

The invention is explained in more detail below by way of example using FIG. 3. of the drawing; this shows a longitudinal sectional view through a preferred embodiment of the ram pump according to the invention. Parts which are functionally identical to those in FIGS. 1 and 2 are designated in FIG. 3 by the same reference numbers.

Figure 3:
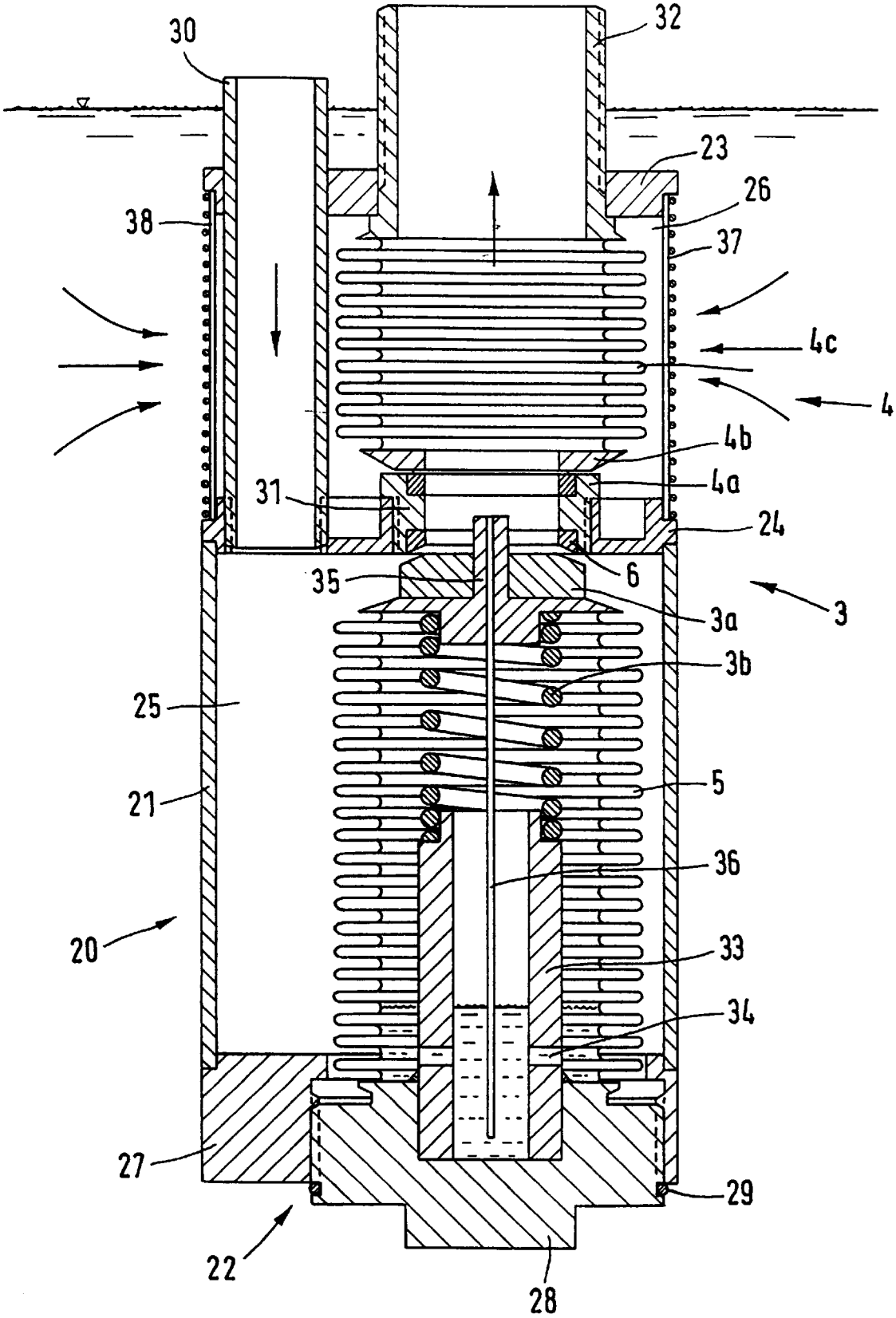
FIG. 3 shows a longitudinal sectional view through a preferred embodiment of the ram pump.

The ram pump shown in FIG. 3 has a generally tubular casing 20 having a cylindrical jacket 21 which is closed at one end, the lower end in FIG. 3, by a bottom 22 and which is closed at its other end, the upper end in FIG. 3, by a lid 23. The interior of the tubular casing 20 is subdivided axially by a partition 24 into a larger-volume subchamber 25 and a smaller-volume subchamber 26.

The bottom 22 of the casing 20 is designed in two parts in the embodiment shown and comprises a ring 27 whose outer circumference corresponds to the outer circumference of the jacket 21, and whose acentric inner circumference has an internal thread into which a closure stopper 28 with an external thread is screwed. In order to seal off the parts 27 and 28 in relation to each other, there is designed at the outer circumference of the closure stopper 28 an annular groove in which there is seated an O ring 29 which is supported on the inner circumference of the ring 27.

A propulsion water line, not shown, is connected to an inlet pipe 30 which passes through a hole in the lid 23 and a corresponding hole in the partition 24. The inlet pipe 30 is tightly connected at least to the partition 24. Inserted tightly into a further hole in the partition 24 is a tubular valve seat carrier 31 which has an annular part 4*a* projecting into the smaller subchamber 26, said annular part 4*a* forming with its outside pointing toward the lid 23 a valve seat 4*b* of the bottom valve 4, which in addition has a restoring spring 4*c* which is formed as a bellows, to one end of which the valve member 4*b* is firmly connected and the other end of which is firmly connected to a pipe connection 32 which passes through a hole in the lid 23, is firmly connected to the latter and is connected to a delivery line, not shown. Formed at the other end of the valve seat carrier 31 is a valve seat 6 in the shape of a conical surface which tapers in the direction of the valve seat 4*a* of the bottom valve 4 and, for the purpose of cooperation, cooperates with a spherical surface, complementary thereto, formed on the valve member 3*a* of the ram pump valve 3, which is likewise formed in the shape of a circular disk which is firmly connected to one end, the upper end in FIG. 3, of a bellows 5 which, as explained below, forms the pressure reservoir of the ram pump and is firmly connected with the other end to the inner surface of the closure stopper 28 in the bottom of the casing 20. Supported on the inside of the annular ram pump valve member 3 is a restoring spring 3*b,* whose other end is supported at the upper end of a supporting pipe 33 which is inserted with its other end in a hole in the closure stopper 28 and is firmly connected to the lather. At the lower end, the supporting pipe 33 is penetrated radially by holes 34 which, on the one hand, open into the interior of the pipe 33 and, on the other hand, open into the inner space enclosed by the bellows 5.

The valve body 3*a* of the ram pump valve 3 has a central hole which is penetrated by a cylindrical body 35 which, with its end pointing toward the bottom valve 4, projects into the inner space enclosed by the valve seat carrier 31 and is broadened at the other end in the manner of a flange, this flange-like end part serving for fastening the valve body 3 to the bellows 5. On that side of the flange pointing toward the bellows 5 there is formed a retaining body for the restoring spring 3*b,* this spring engaging around said retaining body. This body, as well as the flange end of the cylindrical body 35 and the latter itself, are completely penetrated by a capillary bore which finds its extension in a capillary tube 36 which extends as far as into the bottom region of the retaining pipe 33.

The jacket of the casing 20 is preferably pierced at a plurality of locations in the region of the smaller subchamber 26, and metal screens 37 and 38 are seated in these piercings.

As is shown schematically in FIG. 3 by a wavy line at the upper end of the ram pump, the latter is immersed below the surface of a water reservoir.

The mode of operation of the ram pump according to the invention, which is constructed as explained above using FIG. 3, is explained below.

Propulsion water is pumped by an external pump (not shown), via the connecting nozzle 30, into the lower subchamber or pressure chamber 1 of the ram pump. Since the valve member 3 is held by the restoring spring 3*b* in the closed position against the valve seat 6 of the ram pump valve 3, the pressure in the pressure chamber outside the bellows 5 rises, and this rising pressure leads to an elastic deformation of the bellows 5, which preferably consists of metal. This means that the folds of the bellows 5 fulfill the function of a spring reservoir for the hydraulic suction ram.

The liquid pressure building up in the subchamber 25 effects an increasing force on the end face of the bellows 5 carrying the ram pump valve member 3*a,* and this pressure finally overcomes the closing force of the restoring spring 3*b*. As a result, the ram pump valve 3 opens, or its valve member 3*a* comes free of its valve seat, and the liquid pressure which is present in the pressure chamber 25 now acts on the entire end face of the bellows 5 and, respectively, the outer face of the valve member 3*a,* as a result of which the ram pump valve 3 opens still further, and as a result of which the pressure in the subspace 25 falls slightly. In addition, with the ram pump valve 3 open, the pressure in the subchamber 25 acts on the inner space of the bellows 4*c,* which forms the restoring spring for the bottom valve 4, which is still closed at this time, and the delivery water which is present in this inner space, and accelerates the latter, as a result of which the pressure falls further until it falls below that value at which the restoring spring 3*b* presses the valve body 3 once more against its valve seat and thereby closes the ram pump valve, the pressure in the subchamber 25 being built up once more.

The kinetic energy which is transmitted to the associated valve seat 6 by the closure of the rampump valve 3 is transmitted via the valve seat carrier 31 to the valve seat 4*a* of the bottom valve 4, and opens this valve as a result of this elastic shock. At the same time, the kinetic energy entrained in the delivery water is used up, in that the delivery water sucks water from the surroundings against the weight of the delivery water through the bottom valve 4, which is now open, the valve body 4*b* being lifted off the valve seat 4*a*. At the same time, the bottom valve 4 is held open by a slight negative pressure in the bellows 4*c*. As soon as the energy contained in the delivery water has been used up, the bottom valve 4 is closed once more by the spring force resident in the bellows 4*c*.

The kinetic energy of this closing process is transmitted by an elastic shock via the valve seat carrier 31 to the valve seat 6 of the ram pump valve 3 and by the latter to the valve member 3*a* of the ram pump valve 3, as a result of which the latter is opened. At the same time, the delivery water which has just remained stationary swings back slightly because of the elasticity of the bellows 4*c* and produces a small setting shock which promotes the opening of the ram pump valve.

Because of the valve seats, which according to the invention are mechanically coupled or formed in one piece, for the bottom valve 4 and the ram pump valve 3, the closing energy of the respective valve is advantageously employed to open the respective other valve. This advantage cannot be achieved in the case of ram pumps of conventional construction, since the valve seats of the two valves under discussion (the bottom valve is a nonreturn valve) are designed to be separate from one another, so that kinetic energy cannot be transmitted from one valve to the other. The kinetic energy which is released during the closure is rather dissipated by means of damping, for example in the sealing rubber of the valve. Damping of this type is conventionally also necessary in order to prevent the so-called bouncing of the respective valve member on the valve seat. In the case of valves which are designed according to the invention, connected to each other via the valve seat or formed as a material unit, this bouncing does not occur, since the kinetic energy is introduced by the closing valve into the other valve, in order to trigger or to promote its opening.

Conventionally, the flow round a valve member is axial, and the flow runs apart radially between the valve member and the valve seat following the inflow. By contrast with this, the flow in the valves which are designed according to the invention with a common valve seat runs radially inwardly together between the valve members and the associated seats and then axially away from the respective valve. It is only this that provides the capability of a common valve seat. A further advantage of the coupling of the valve seats of the two valves, according to the invention, consists in the fact that the section between the two valves can be kept negligibly short.

By means of a simple measure, the ram pump according to the invention and explained above can also be operated as a normal ram. For this purpose it is merely necessary to provide an additional spring which has the effect that the bottom valve 4 is open in the rest position. The mode of operation of this modified ram pump is as follows:

Initially, the delivery water is accelerated because of its natural fall, and it emerges into the open through the opened bottom valve 4 via the tube connection 32 until a hydrodynamic negative pressure between the valve member 4*b* and the valve seat 4*a* and a backpressure in the bellows 4*c* effect the closure of the bottom valve 4. As a result, the ram pump valve 3 opens, and the kinetic energy of the delivery water charges the spring reservoir (bellows 5), as a result of which the ram pump valve 3 closes once more and the process, as explained above, begins again from the beginning. However, if the spring reservoir (bellows 5) is already charged (that is to say no water under pressure is consumed), the bottom valve 4 does not close when the delivery water has come to a standstill but only after the excess energy from the spring reservoir has accelerated the delivery water in the converse manner or backward. Following the closure of the ram pump valve 3, the delivery water then initially sucks water in through the bottom valve 4, until the flow direction reverses. This means that, if no water under pressure is needed, the consumption of delivery water also returns to a minimum.

The purpose of the capillary tube 36 or the capillary opening in the valve member (FIG. 3) is that the pressure in the interior of the bellows 5 becomes equal to the average pressure in the bellows 4*c* and in the delivery line. This achieves the situation where the pressure difference between propulsion water and delivery water, at which the ram pump valve opens, is independent of the delivery head. And as a result the load on the external propulsion water pump is always the same, irrespective of whether the ram pump is employed to deliver large quantities of surface water or small quantities of water from a great depth.

What is claimed is:

1. A hydraulic ram pump, comprising:

a propulsion water line (1), a delivery line (2) which receives delivery water via a bottom valve (4), a ram pump valve (3) which is connected to the propulsion water line (1) and delivery line (2), the propulsion water flowing into the delivery line when the ram pump valve (3) is open and, after closing of the ram pump valve, the water column flowing further in the delivery line sucking in delivery water via the bottom valve (4), the ram pump valve (3) being arranged coaxially with the bottom valve (4) with mutually adjacent valve seats and held by spring force in its closed position separating the propulsion water line from the delivery line, and a pressure reservoir (5) being provided, which is connected to the propulsion water line upstream of the ram pump valve (3) in the direction of flow wherein the pressure reservoir (5) has a bellows which is supported at one end in a subchamber (25) of a two-part casing and is acted on externally by the propulsion water, which is conducted into this subchamber (25) of a two-part casing and is acted on externally by the propulsion water, which is conduced into this subchamber (25) via the propulsion water line (30), and which carries at the other end the valve member (3*a*) of the ram pump valve (3), the valve seat (6) of which is seated in a partition (24) subdividing the casing (20) and is connected to the valve seat (4*a*) of the bottom valve (4), and which is arranged in the other subchamber, which communicates with the delivery water.

2. The hydraulic ram pump as claimed in claim 1, wherein the ram pump valve (3) and the bottom valve (4) are essentially arranged coaxially, with mutually adjacent valve seats.

3. The hydraulic ram pump as claimed in claim 1, wherein the two valve seats (4*a*, 6) are formed at the opposite ends of a valve seat carrier (24).

4. The hydraulic ram ovum as claimed in claim 1, wherein the bellows (5) serves as an elastic, variable-volume component of the pressure reservoir, without changing its axial extent in order to store pressure.

5. The hydraulic ram pump as claimed in claim 1, wherein a restoring spring (3*b*) for the ram pump valve (3) is arranged in the interior of the pressure reservoir bellows (5), runs coaxially with the latter and is supported with one end on the inside of the valve (6) of the ram pump valve (3) and with its other end on the casing (2).

6. The hydraulic ram pump as claimed in claim 1, wherein the valve member (3*a*) of the ram pump valve (3) is penetrated by a capillary bore which connects the interior of the pressure reservoir bellows (5) to the space between the valve member (4*a*) of the bottom valve (4) and the valve member (6) of the ram pump (3).

7. The hydraulic ram pump as claimed in claim 5, wherein a capillary tube (36), which extends as far as into the bottom region of the pressure reservoir bellows (5), is connected to the capillary bore.

8. The hydraulic ram pump as claimed in claim 1, wherein the bottom valve (4) has a bellows (4*c*) which at its one end carries the valve member (4*a*) of the bottom valve (4), and at its other end is supported on the casing (20) in such a way that this valve member (4*b*) is forced against its valve seat (4*a*) in the closed position.

* * * * *